US007373756B2

(12) United States Patent
Okulov et al.

(10) Patent No.: US 7,373,756 B2
(45) Date of Patent: May 20, 2008

(54) AUTOMATIC PORTABLE DOOR OPERATING SYSTEM

(75) Inventors: Paul D. Okulov, Lachine (CA); Amir Zouak, Lachine (CA)

(73) Assignee: 4378580 Canada Inc., Notre Dame de l'Ile Perrot, Quebec (CA)

( * ) Notice: Subject to any disclaimer, the term of this patent is extended or adjusted under 35 U.S.C. 154(b) by 298 days.

(21) Appl. No.: 10/933,409

(22) Filed: Sep. 3, 2004

(65) Prior Publication Data

US 2005/0091928 A1 May 5, 2005

Related U.S. Application Data

(60) Provisional application No. 60/499,348, filed on Sep. 3, 2003.

(51) Int. Cl.
*E05F 11/24* (2006.01)

(52) U.S. Cl. ..... 49/346; 49/339; 49/341

(58) Field of Classification Search ..... 49/339, 49/341, 340, 346, 324, 25
See application file for complete search history.

(56) References Cited

U.S. PATENT DOCUMENTS

| | | | | |
|---|---|---|---|---|
| 1,684,704 A | | 9/1928 | Hubbell | |
| 1,941,454 A | * | 1/1934 | Ainsworth | 49/26 |
| 2,256,613 A | | 9/1941 | Forman et al. | |
| 2,910,290 A | | 10/1959 | Buchanan | |
| 3,127,160 A | | 3/1964 | Wallmann | |
| 3,129,936 A | | 4/1964 | Carlson | |

(Continued)

FOREIGN PATENT DOCUMENTS

| | | |
|---|---|---|
| DE | 37 30 114 | 5/1988 |
| DE | 41 24 282 | 1/1993 |
| DE | 43 23 150 | 11/1997 |
| EP | 0 632 181 | 1/1995 |
| GB | 475073 | 11/1937 |
| WO | WO 89/11578 | 11/1989 |

OTHER PUBLICATIONS

Gerba, Charles, professor of microbiology at University of Arizona; "Microorganisms in Public Washrooms"; presented at ISSA media briefing in Atlanta, Georgia, U.S.A.; Oct. 1995.

O'Connor, Jewkes RK, BH; "Crisis in our schools: survey of sanitation facilities in schools in Bloomsbury health district."; BMJ, Nov. 10, 1990; 301 (6760):1085-7.

(Continued)

*Primary Examiner*—Jerry Redman
(74) *Attorney, Agent, or Firm*—Paul Sharpe; Ogilvy Renault LLP

(57) ABSTRACT

The present invention relates to a door operating system for controlling the movement of a door, more particularly to "no touch" door openers for public washrooms and households. The system has a motor with a gear chain where the high gear is generally semicircularly shaped engaged with a swinging arm coupled with the door through the roller and a pilot plate. The unit is activated upon receipt of the signal from overhead passive infrared or hand proximity detecting sensors and has a controlling system to provide for opening and closing the door, as well as retraction of the arm in the event of door encountering an obstacle or in an overload condition of the motor. The arm and a gear are linked pivotally with each other and with the unit housing. They are coupled through a spring suspension system and have a clutch mechanism preventing overloading. The only external moving part is the arm, which is, along with geared sector, protected by a flexible member providing security to prevent accidental jamming of objects by it. The unit may be battery operated with a low voltage and low power AC/DC switching wall adapter. In autonomous operation it can provide up to 700 opening cycles without external power.

10 Claims, 11 Drawing Sheets

U.S. PATENT DOCUMENTS

| | | | | | |
|---|---|---|---|---|---|
| 3,284,950 | A | * | 11/1966 | Gute | 49/28 |
| 3,864,875 | A | * | 2/1975 | Hewitt | 49/264 |
| 3,874,117 | A | | 4/1975 | Boehm | |
| 3,936,977 | A | | 2/1976 | Runft et al. | |
| 3,948,000 | A | | 4/1976 | Pedersen | |
| 4,040,144 | A | | 8/1977 | Lasier et al. | |
| 4,045,914 | A | | 9/1977 | Catlett | |
| 4,220,051 | A | | 9/1980 | Catlett | |
| 4,222,147 | A | | 9/1980 | Burnett, Jr. | |
| 4,261,440 | A | | 4/1981 | Jacoby | |
| 4,339,842 | A | | 7/1982 | Fontana et al. | |
| 4,348,835 | A | | 9/1982 | Jones et al. | |
| 4,365,442 | A | * | 12/1982 | Speer | 49/346 |
| 4,378,612 | A | | 4/1983 | Beers | |
| 4,414,703 | A | | 11/1983 | Schnarr et al. | |
| 4,429,490 | A | | 2/1984 | Zunkel | |
| 4,438,835 | A | | 3/1984 | Dowden et al. | |
| 4,660,324 | A | | 4/1987 | Nyenbrink | |
| 4,727,679 | A | | 3/1988 | Kornbrekke et al. | |
| 4,793,023 | A | | 12/1988 | Simpson et al. | |
| 4,831,509 | A | | 5/1989 | Jones et al. | |
| 4,952,080 | A | | 8/1990 | Boiucaner et al. | |
| 4,955,194 | A | | 9/1990 | Christensen et al. | |
| 4,995,194 | A | | 2/1991 | Schultze et al. | |
| 5,040,331 | A | | 8/1991 | Merendino et al. | |
| 5,101,595 | A | | 4/1992 | Rhoades | |
| 5,375,374 | A | | 12/1994 | Rohroff, Sr. | |
| 5,392,562 | A | | 2/1995 | Carambula | |
| 5,687,451 | A | | 11/1997 | Singer | |
| 5,727,348 | A | | 3/1998 | Arnell et al. | |
| 6,002,217 | A | | 12/1999 | Stevens et al. | |
| 6,241,300 | B1 | | 6/2001 | Suzuki | |

OTHER PUBLICATIONS

Koopman, JS; "Diarrhea and school toilet hygiene in Cali, Colombia"; American Journal of Epidemiology, vol. 107, Issue 5 412-420, 1978, Oxford University Press.

Mendes, MF and Lynch, DJ; "A bacteriological survey of washrooms and toilets."; Journal of Hygiene; 1976; 76:183-190.

Davey, Tom; "Is washroom hygiene as important as gun control?"; Environmental Science & Engineering; May 2002.

Firfer, Holly, CNN correspondent; "People's hand-washing tales a whitewash, study says"; Sep. 18, 2000.

Cannon Hygiene; "Healthy washroom. Healthy people. Healthy business."; copyright 2000-04 Cannon Hygiene Canada.

Market Pulse; "Washroom Care"; Aug. 2001.

Biography Magazine; "What You Don't See Can Hurt You"; Apr. 1999.

Strobel Kari; "Hands Down: Touch-Free Washrooms Win"; Sanitary Maintenance; Aug. 2001.

Muha, Laura J.; "What You Don't See Can Hurt You"; Biography Magazine; Apr. 1999.

* cited by examiner

AUTOMATIC PORTABLE DOOR OPERATING SYSTEM

CROSS-REFERENCE TO RELATED APPLICATIONS

This application claims benefit of U.S. Provisional Application No. 60/499,348, filed Sep. 3, 2003.

FIELD OF THE INVENTION

The present invention relates to an apparatus and method for controlling the operation of a door, and, more particularly, the present invention relates to devices for automatic opening or/and closing of swing type doors.

BACKGROUND OF THE INVENTION

Hydraulic and pneumatic door controlling devices for swing doors are well known (U.S. Pat. Nos. 4,793,023, 4,414,703 and 4,378,612.). Hydraulic and pneumatically operated openers, or opening assist mechanisms are also known from the prior art as exemplified in U.S. Pat. Nos. 3,948,000, 3,936,977, 4,955,194, and 4,429,490. Further, electromechanical automatic door openers are known, for example, from U.S. Pat. Nos. 2,910,290, 3,127,160, 4,045, 914 and 4,220,051. Each type of these door openers has its own advantages and disadvantages.

There are also combinations of such devices known from the prior art, for instance, U.S. Pat. Nos. 3,874,117, 3,129, 936, 1,684,704, 2,256,613, and 4,438,835. The additional expense associated with the manufacture and operation of such units is relatively high. As an example, when a clutch or other disengagement mechanism is required for operation, the resulting system can become too expensive, especially for widespread use. This limits the applications for such improved door openers to entrance doors and automated doors for handicapped people leaving the market of fast food restaurants and hygienic applications unattended.

The present invention addresses an automatic door opener designed for public washroom facilities application to enhance sanitary practices. The objective of employing this product is to reduce microbiological and bacterial surface contact cross contamination when exiting public washroom facilities.

Regardless of the level of cleanliness and preventative measures such as "No Touch" toilet flushing mechanisms, "No Touch" taps, hand air-dryers and rigorous floor cleaning programs, the last point of contact prior to exiting the washroom, on a consistent basis, is the door pull-handle. Previous studies have indicated the presence of micro organisms and the subsequent microbial contamination in public washrooms. This is further aggravated by the fact that only 50% of washroom users wash their hands prior to leaving the washroom. This indicates that the incidence of cross contamination at the door pull-handle is actually 100%, as 100% of users will make physical contact with the door pull-handle in order to exit.

Given the serious incidences of public health and concerns such as the Norwalk virus, SARS etc., eliminating and/or reducing all possible sources of cross contamination in public places is a serious matter that bears responsibility on entrepreneurs to bring about affordable and practical solutions to deal with this issue.

Most door operating systems do not possess any features that would suspend the door opening if any obstacle in its way is encountered. The systems which do have such features, such as that which is described in a U.S. Pat. No. 6,002,217 are complex and unreliable due to the fact that door inertia and dynamic loads during the door operation can be easily misrepresented by a controller as an overload condition, which creates a pattern of malfunction.

Another issue with the known door operating systems is bulkiness and that they occupy most of the width and considerable height of the swing door upper frame. This creates an unappealing addition to the interior of the office, house or washroom. The high price of such devices stems from the complexity of the design itself and creates a challenging barrier for penetration to such powerful and potent markets as highly frequented public areas.

This applicability of the present system can be enjoyed by businesses providing public washroom facilities in the industrialized world: hospitality industry (bar, restaurants, hotels), healthcare facilities (hospitals), educational centers (schools, colleges, universities and libraries), shopping malls, government buildings, entertainment centers (theatres, cinemas, nightclubs), day care centers (very young children are part of the most susceptible population group affected by this kind of contamination as their immune systems are still immature) The "No Touch" product of the present invention will be offered at a fraction of the cost of what is available today.

Although a multitude of swinging door automatic openers are available in the marketplace, particularly for disabled function applications, these are quite sophisticated and elaborate, however their purchase and installation costs make them prohibitive for a sanitary application such as it is envisaged with the instant technology.

As a general rule, most door operating systems are-not capable of functioning during power blackouts. Since most automatic door operating system can naturally be situated in public facilities such as hospitals, offices, restaurants, etc., the loss of power paralyzes these devices. As this present invention offers an operating system that is not attached to the door, it will not prevent normal (unassisted) manual operation of the door in a power blackout situation. Moreover, in the battery operated variation it can provide up to 700 opening cycles autonomously.

The present invention addresses all these problems by providing an improved automatic door operating system.

SUMMARY OF THE INVENTION

One object of the present invention is to provide a portable and inexpensive apparatus for controlling the operation for a swing type door.

A further object of one embodiment of the invention is to provide an automatic portable door operating system for controlling the movement of a door, said system comprising a housing; an arm extending from said housing having a free end for contacting a door for opening and closing said door, said arm being independent of said door; gear means connected to said arm for imparting movement to said arm; a motor for providing movement to said gear means; sensor means for actuating said system; a power supply for supplying power to said motor; and control means for controlling said motor.

Still another objective of one embodiment of the present invention is to provide a device extremely simple in its design and installation, including the installation in either left or right hinged doors, in-swinging or out-swinging doors.

A further object of one embodiment the present invention is to provide an automatic portable door operating system for controlling the movement of a door, said system comprising a housing; a pair of motors having a common axle, said axle being threaded; a carrier reciprocally movable on said axle in response to actuation of said motors; an arm extending from said housing having a free end for contacting a door for opening and closing said door, said arm being independent of said door; linkage means connecting said arm and said carrier; sensor means for actuating said system; a power supply for supplying power to said motor; and control means for controlling said motor.

Yet another objective of the present invention is to provide a door operating system with an energy back-up device.

Still another objective of the present invention is to provide a low cost door operating system, requiring low energy for operation and which may be easily installed.

At last another objective of the present invention is to increase its safety and provide for an automated switching the device OFF if any moving part of it accidentally jams any object.

The present invention comprises a door operating unit and a sensory means for sensing the presence of the subject in a pre-designed proximity to the door or to the designated part of the door. The unit can operate either on conventional 110/220 VAC or be battery/storage capacitor operated, or both.

The door operating unit in its preferred configuration comprises a metal, preferably stainless steel housing attached to the upper portion of the door frame near its side which is close to the door hinges. The unit is operated by a rechargeable NiCd battery with an external charging AC/DC switching adaptor and a motor controller based on a H-bridge MOSFET technology. In its AC operated variation the unit can have an internal power supply, preferably in a form of a toroidal step-down transformer with low noise emissions, a rectifying circuit, a motor controller with CPU and/or logic switch system which manages the activation, deactivation of the DC motor and handles direction of its rotation.

A DC motor can be furnished with a gear chain providing for the reduction of the speed of rotation and increase of the torque. The last stage of the gear chain is a sector or semicircular shaped gear pivotally connected to the arm and to the housing. The arm, during its swinging, contacts the inner surface of the door through the roller and a strike (pilot) plate.

Optionally, an AC operated door opener can have an energy back up system either in a form of a rechargeable battery or a super capacitor or both, capable of providing the unit operation in emergency situations and keeping the door closed/opened in case of fire depending on the safety procedures designed for a particular building.

The door operating system also has an electric motor with a shaft for providing rotational energy to the system and a gear/pushing arm assembly for converting the rotational energy from the motor shaft to the swinging movement of the door. In the preferred configuration, the gear assembly includes a worm gear associated with a gear couple where the last gear in a chain has a shape of a geared sector.

It is also desirable to provide a clutch mechanism preventing the gear from overloading.

The system has a Passive Infra Red (PIR) Detector or a Touchless Hand Sensor (THS) utilizing capacitance or infra red sensing means, which generate an impulse of desired duration upon detecting a person in certain proximity to the door or to the sensor itself. For ADA applications these sensors can have a prolonged duration of the impulse settings, which would provide longer exit time for impaired persons.

The logic switching system then executes activation of the motor and subsequent opening of the door. Unless the PIR detector goes OFF the door will remain open which allows the door to be kept open when significant traffic is experienced.

Alternatively, the device can also operate an electromechanical lock to unlock the door before door opener opens it, and/or can have an encoding non-touch unlocking circuitry to be part of smaller washroom door operating systems. It can also utilize wireless configurations, proximity card readers and controllers, etc.

Having thus generally described the invention, reference will now be made to the accompanying drawings illustrating preferred embodiments.

DETAILED DESCRIPTION OF THE PREFERRED EMBODIMENTS

Figure 1:
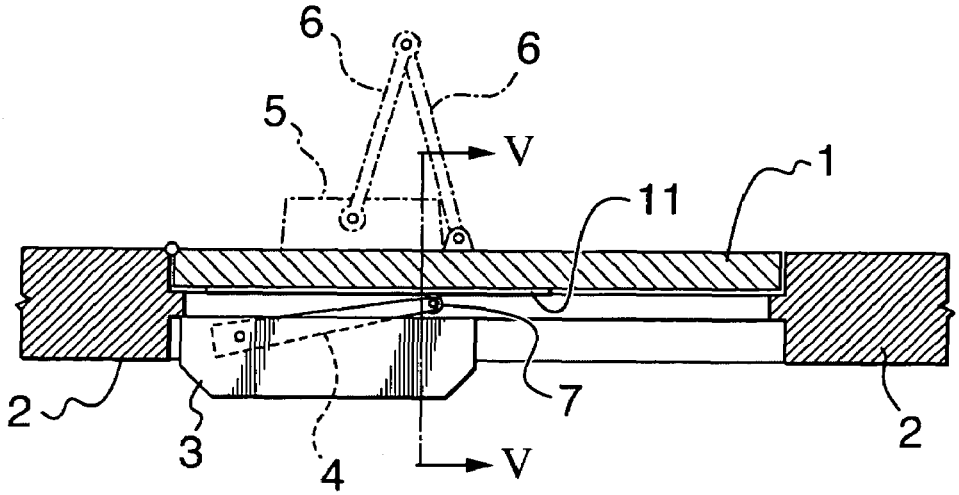
FIG. 1 is an elevation of the door frame showing the door and the door opener in closed position.
Figure 2:
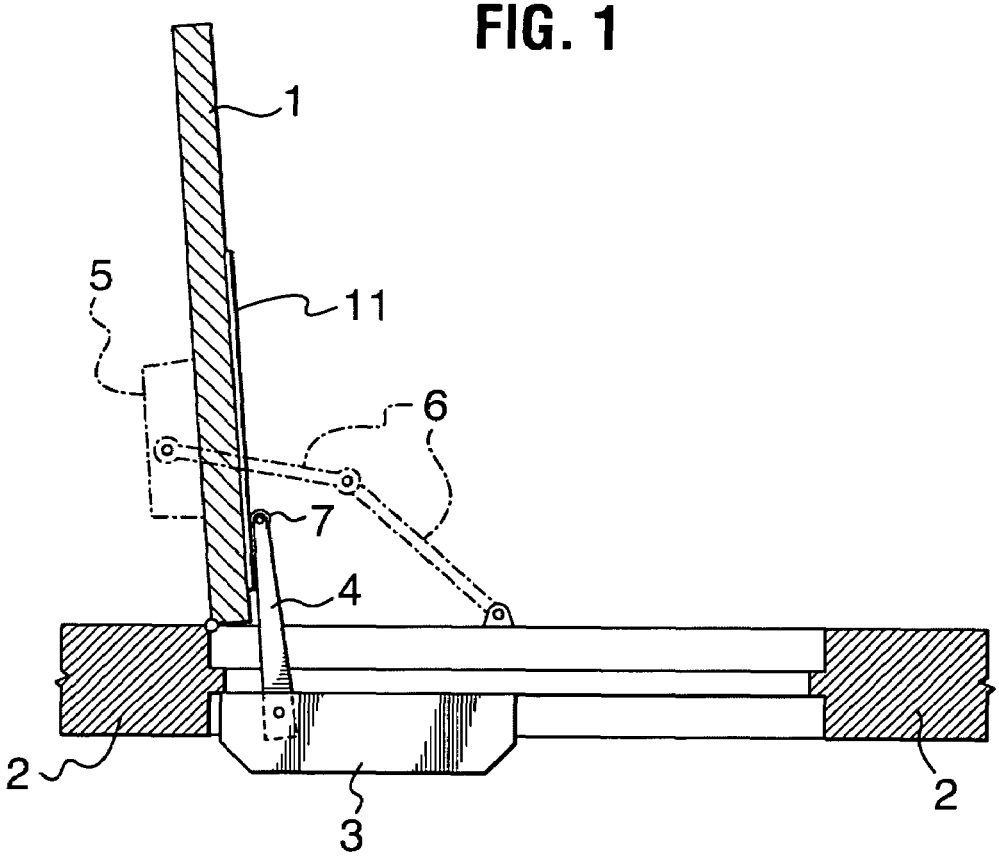
FIG. 2 is a view similar to FIG. 1 with the door fully opened.
Figure 3:
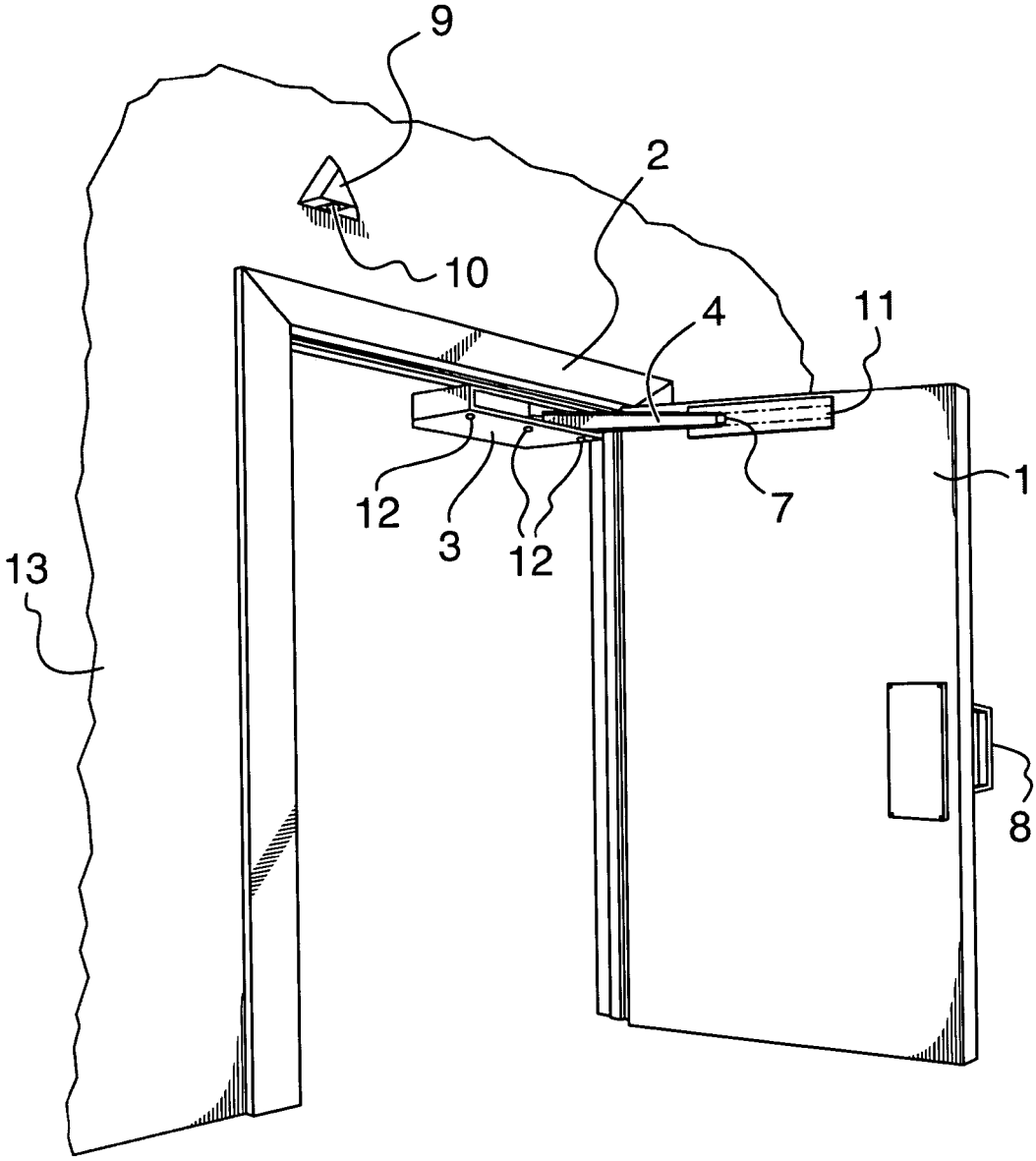
FIG. 3 represents a general perspective view of the opened door, door opener, pilot plate and positioning of PIR sensor on the wall above the door.

Referring now to FIGS. 1 through 3 and 5 there are shown a swing door 1 with hinges on its left side, frame 2 accommodating such door 1, door opener 3 attached to the upper portion of the frame 2 by means of three screws 12 (FIG. 3). The door opener 3 has an arm 4 pivotally connected to its housing and having a roller 7 at its free end. Alternatively, the door can contain a door closer spring consisting of the housing 5 with linked arms 6.

When swung, the arm 4 pushes the door 1 through the pilot plate (strike plate) 11. When the arm 4 is retracted, the door is closed either by the action of the door closer or by the arm 4, which can have a link with the door 1 through the pilot plate 11 or by other means. The invention in one of its practical variants has a Passive Infra Red (PIR) detector 9 attached to the wall 13 with lens 10 facing the area near the handle 8 of the door 1 (when the door is in closed position). One of the possible variants of such detector is a PARADOOR™ 460 manufactured by PARADOX, Inc., Canada.

Figure 4:
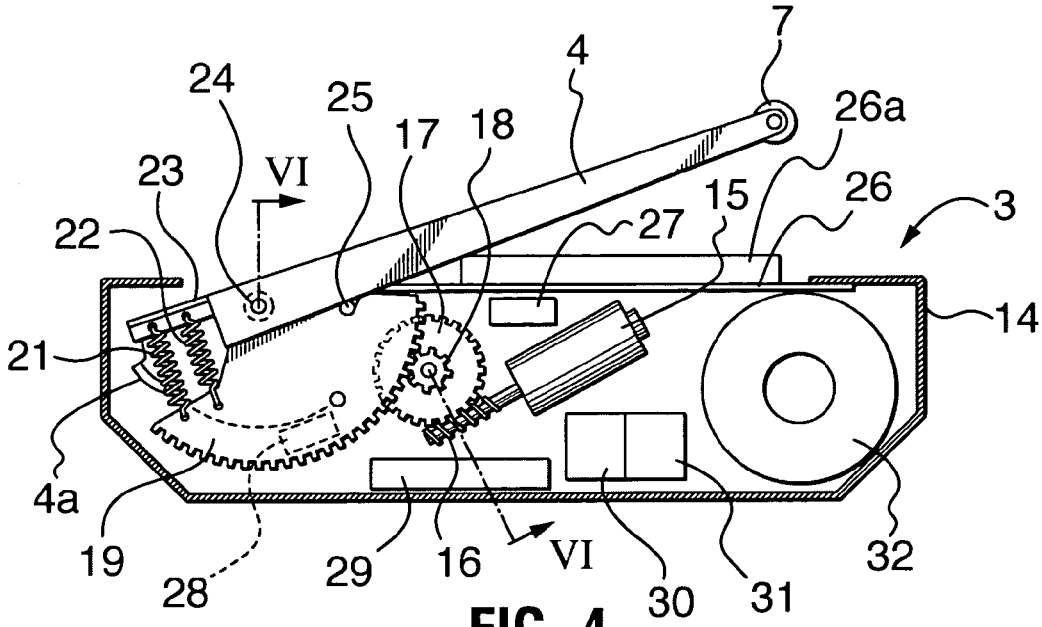
FIG. 4 is a detailed view of the unit showing the arm, geared sector and gear chain with motor as well as placement of other components of the device.
Figure 5:
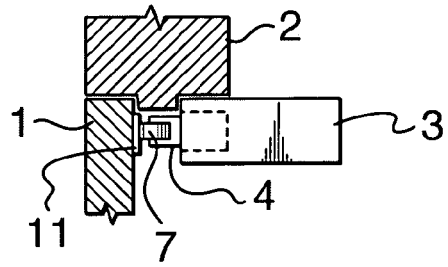
FIG. 5 is a cross section of the unit showing its position relative to the door and its frame referred to in FIG. 1.
Figure 6:
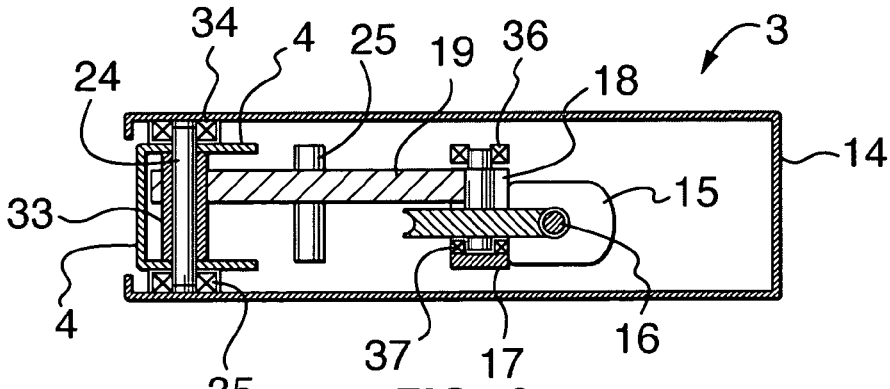
FIG. 6 is an elevational view of the present invention referred to in the FIG. 4.

The door opening unit 3 shown in FIG. 4 in greater detail provides a housing 14, preferably made of stainless steel, with an arm 4 pivotally linked with the housing 14 by a shaft 24 and ball bearings 34, 35 (FIG. 6.). The energy needed for door operation comes from a DC motor 15, which has a worm gear comprised of gears 16 and 17 having bearings 36, 37 linked though a gear chain (17, 18) with a sectored gear 19. The gear 19 can rotate around the shaft 24 using a tubular bearing 33.

Figure 11:
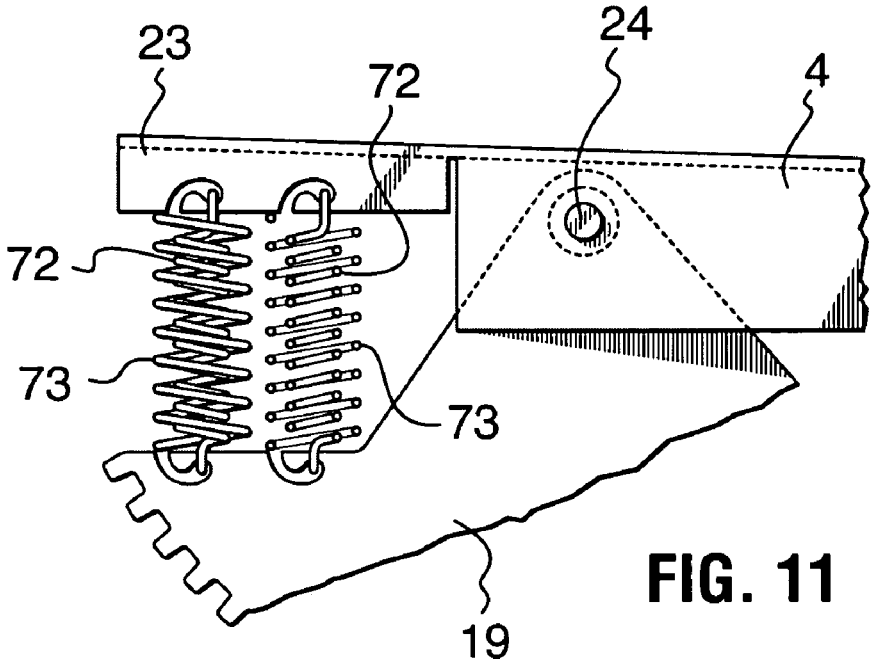
FIG. 11 is a view of the suspension system incorporating pre-stressed compression and tension springs.
Figure 12:
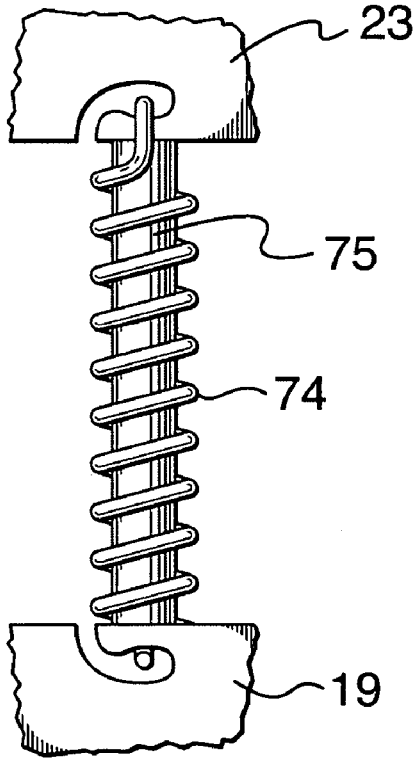
FIG. 12 is a view of the suspension system with a tension spring and pre-stressing pin or tubular shell for the spring.

The sectored gear 19 allows for compact and a high torque ratio between motor 15 and arm 4 and is linked with arm 4 through a spring suspension system, consisting for example of one or several tension, or/and composite prestressed "tension+compression" (FIG. 11) or a "tension+limiting device" (FIG. 12) springs (see for instance 21, 22 and also 72, 73, 74, 75, FIGS. 11, 12).

The sectored gear 19 has a pin or boss 25 providing for direct contact between the arm 4 and gear 19 when the suspension system is at its limit of deformation. The suspension system provides for dampening of dynamic loads when the door opens or closes and also provides an additional safety for the arm 4 when the opening door meets an obstacle. Deformation of such suspension spring can also be utilized for incorporation of a simple overload protective circuitry.

Figure 6A:
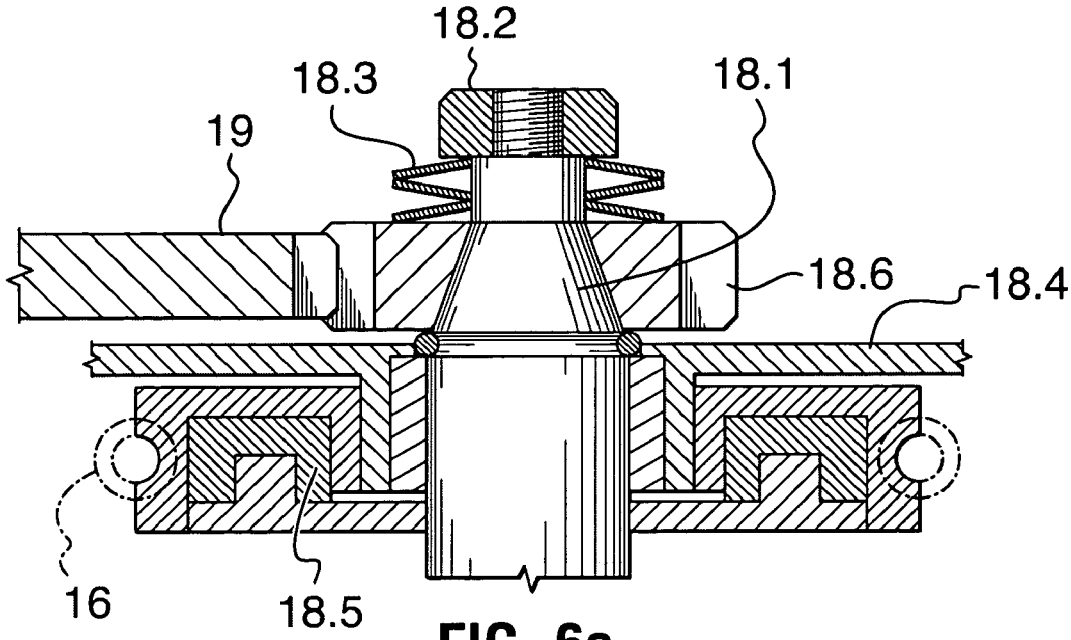
FIG. 6*a* is a cross section of the clutch mechanism utilizing a conical seat for a pinion gear and abrasive grease.

Alternatively, the overloading of the system can be mechanically managed by introduction of a clutch or torque limiter device into any part of it. Practically it is most desirable to incorporate such a device into a pinion gear itself, which reduces the overall size and complexity of the gear train with clutch. An illustration of this device is shown in FIG. 6*a*.

The main shaft 18.1 has a conical section conforming to a conical hole in a pinion gear 18.2. Both parts are under compressive load controlled by several spring washers 18.3. For the purpose of uniformity of friction between the conical parts a greasing compound 18.4 with a controlled size abrasive or friction particles can be introduced. This provides torque limiting at a preset level and can serve as a safety measure, additionally in the cases of possible vandalism or total system failure where it will allow the arm to be closed manually. A gear box 18.4 is provided and includes an elastic damper 18.5. Pinion gear 18.6 is connected to sectored gear 19.

The system also has a power supply unit, comprising of a toroidal step-down transformer 32 or several transformers (see FIG. 10), a rectifying device 30 and a logical switch and/or motor controller 31. The arm 4 activates the end sensing means, which limits its swinging angle to a pre-designed or adjustable value. The sensing means can be of electromechanical, opto-electric, capacitance, inductive, Hall effect or any other suitable nature. In the practical device described herein the sensing means are provided in a form of micro-switches 27 and 28 which can be activated by arm sections 4 and 4*a*) on the opening of the door and by the arm 4 itself by pushing the protective flexible plate 26 and activating another micro switch 27 on the of the retraction of the arm (door closing).

Protective plate 26 stops the motor when the arm 4 is retracted or when the geared sector 19 or arm 4, or both jam accidentally on object. Plate 26 may include a soft pad 26*a* for protecting plate 26 from damage. In the last instance, the jammed object results in the bending of the protective plate 26 inward and activates the switch 27, which in turn, disables motor 15. This allows for manual operation of the door. The plate 26 can also be bent by boss or pin 25. This becomes a necessity when the suspension system (21, 22) does not have a stopper in order to prevent the situation when the geared sector 19 is retracted too far inside the housing 14, while the arm 4 remains partially open.

An advantageous feature of the system according to the present invention is that it is possible to manually operate the door in case of a power failure.

Figure 7:
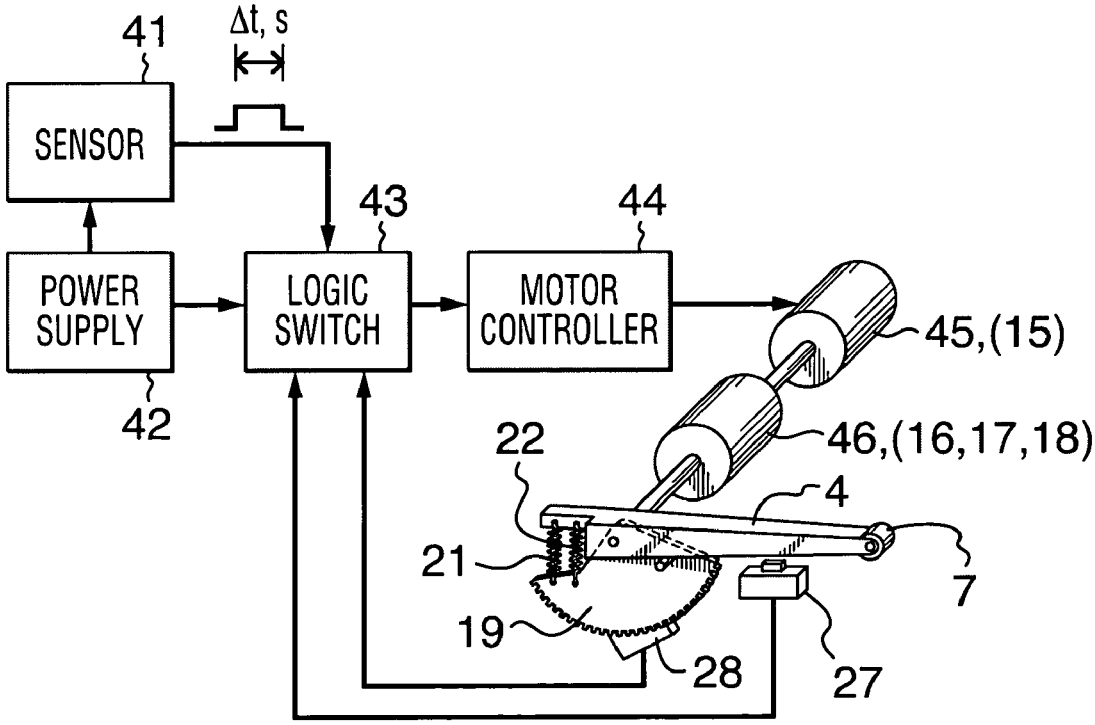
FIG. 7 is a block-diagram of the device.

Referring now to FIG. 7 a block-diagram of the device is shown, the sensor 41 can be in a form of any suitable device, which detects the situation of the door simply needed to be opened. These can include a passive infrared detectors, motion detectors, sensing means for key-less entry or exit, proximity sensors or proximity card readers, wireless (remote) signal receiver and others. The sensor should generate a signal of pre-determined duration (Delta t, sec., FIG. 7).

The choice of power supplies 42 also is not limited only to a transformer/s with rectifiers, but can be provided in the form of a rechargeable battery or super-capacitor, solar cells or any other suitable power supply unit.

Conveniently, the retraction of the arm can be provided at a slower than opening speed. For additional safety, and in case of power failure, a super capacitor can provide sufficient energy for at least one safe closure of the arm.

A logic switch 43 provides a signal (based on a status of sensor 41 and arm swing limits sensing means 28, 27) containing information on the direction of rotation of the motor and its status ("stop"-"go") through a controller 44 according to a logical algorithm of the door operation mode chosen. Motion means 45, for instance an electric motor 15, is linked to the arm 4 through a torque-speed converting means 46, which can be a gear chain (16, 17, 18).

Figure 8:
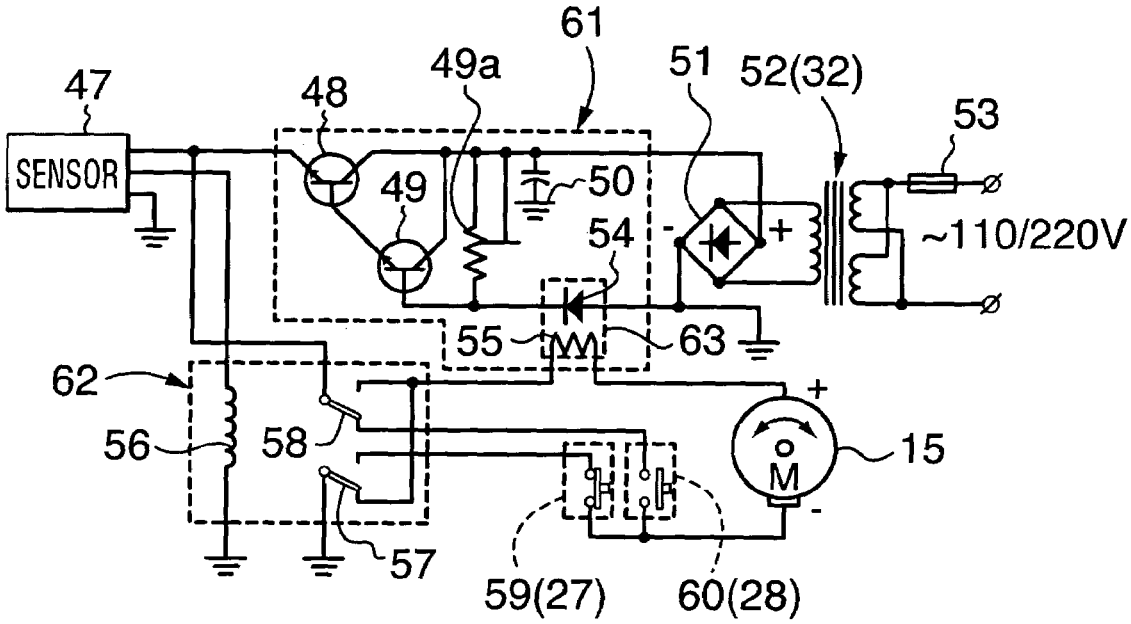
FIG. 8 is a schematic diagram of the electric circuit of the device utilizing electro-mechanical logical switching device and electronic overload sensory device.

A practical diagram providing for a very low cost and yet very durable door opening device is illustrated in FIG. 8. A PIR sensor 47 is powered by a DC voltage provided by a transformer 52 with rectifier 51 and filtering/energy storing capacitor 50 (it also can be a back-up rechargeable battery coupled with it (not shown)) The overload circuitry 61 contains a Germanium diode 54 combined with heater 55 (resistive for instance) connected into the circuit of a motor 15 supply and coupled with transistors 48, 49 with adjustable resistor 49*a*, which determines the threshold voltage (depending on the temperature of the diode) at which the transistors become closed (see FIG. 9).

When the sensor 47 provides an output impulse of duration (Delta t), which may be pre-set in the case of a PARADOOR™ 460 sensor, the relay 62 is energized and the current is directed to motor 15 through the coil of the heater 55 and normally closed micro-switch 59 (27). The arm starts its swinging movement and upon reaching the end limit disconnects the current through the motor 15 by micro-switch 59 (27).

As soon as the arm starts its movement, the switch 60 (28) which is normally open, closes. When the output impulse from the sensor 47 expires, the coil 56 is de-energized and the relay returns to its normal configuration. This causes the motor 15 to reverse its direction and the arm 4 returns in retracted position. The switch 60 (28) opens and the motor stops.

When the door is being closed, activation of the sensor 47 will provide for immediate reversal of the motor 15 and the door opening. If the door is open and sensor 47 detects the presence of another person in a door way, the door will remain open, which will allow to eliminate overworking of the door opening mechanism in high traffic conditions.

Figure 8A:
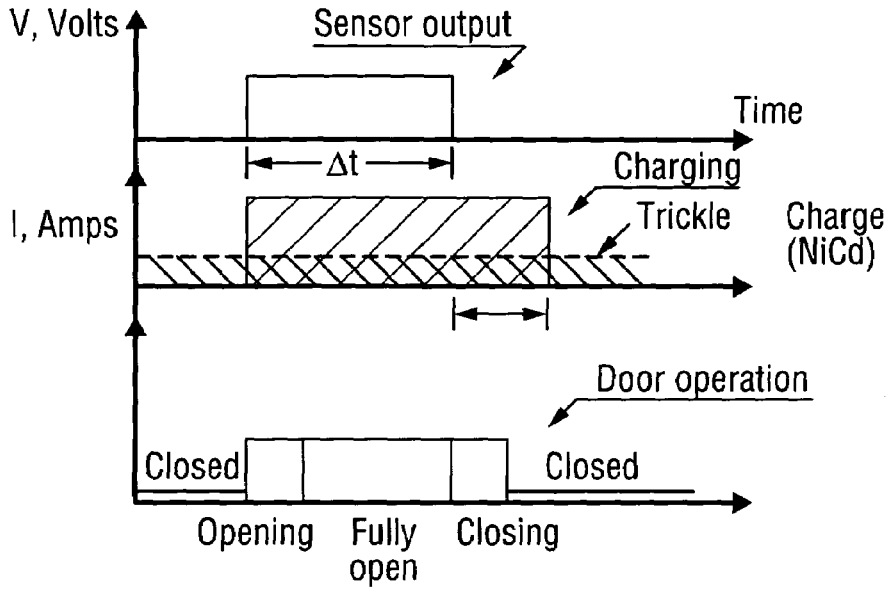
FIG. 8*a* is a graphical representation of the current time relationship for the door operation and battery charging.

FIG. 8*a* is a graphical representation of the current-time relationship for the door operation and battery charging management.

Figure 8B:
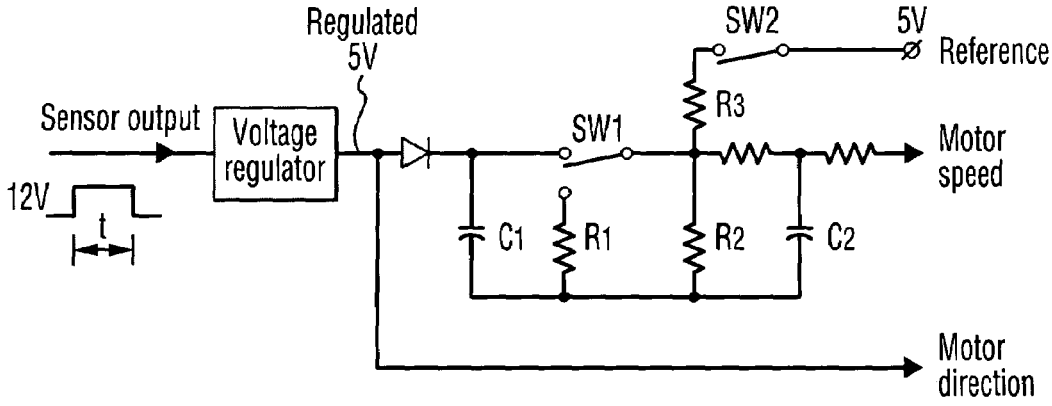
FIG. 8*b* is a schematic diagram of the circuitry responsible for providing speed and direction control of the motor.
Figure 8C:
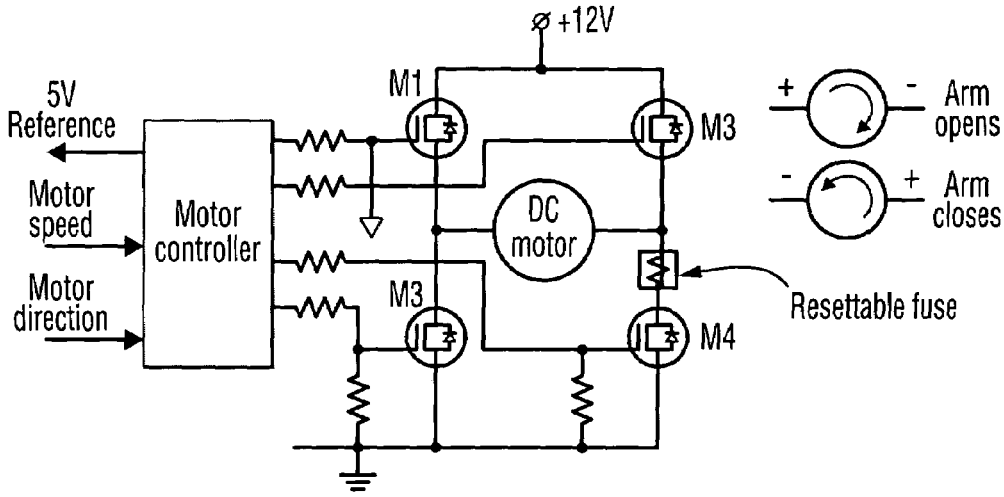
FIG. 8*c* is yet another variant of a motor driver utilizing an H-bridge with MOSFET transistors and illustrating a protective resettable fuse.

FIG. 8*b* presents yet another variant of management of motor speed and direction by employing a resistor network and capacitors, the charging and discharging of which is accomplished by switches SW1 and SW2. As an example, when the signal indicating a person's presence is generated by the PIR or Touch less Hand Sensor (THS) it provides an impulse indicating the motor direction as "open". At the same time, the motor speed controlling signal is set to its value V1 by a voltage regulator (see FIG. 8*e*). Upon reaching the full extent of the arm, switch SW1 is engaged and is turned into the grounded position through the resistor R1 which, in turn, reduces the motor speed voltage to V2. This voltage is just sufficient to keep the door open, but not move it. Upon expiration of the input signal, the motor is reversed (as voltage on motor direction input goes to zero) and when the arm is fully retracted, switch SW2 interrupts the voltage on the motor speed input setting it to zero, which stops the motor. Capacitor C1 provides a small delay in signal on the motor speed input necessary for activation of an electric strike (in case of a latched door) and slow acceleration of the motor; capacitor C2 provides slow deceleration of the motor.

FIG. 8*b* illustrates an example of circuitry for motor controlling using MOSFET transistors arranged in H-bridge.

Figure 8D:
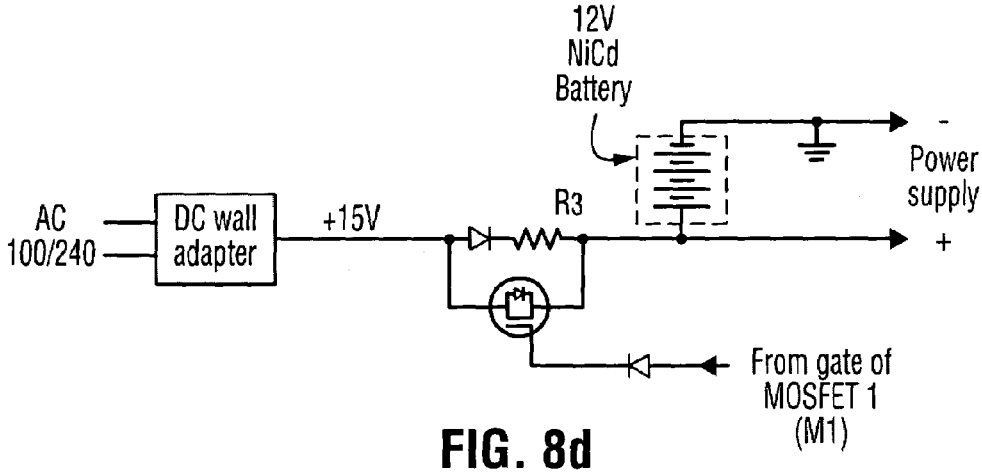
FIG. 8*d* is a schematic illustration of a simple device providing a higher recharging pulse during and shortly after completion of an opening cycle.
Figure 8E:
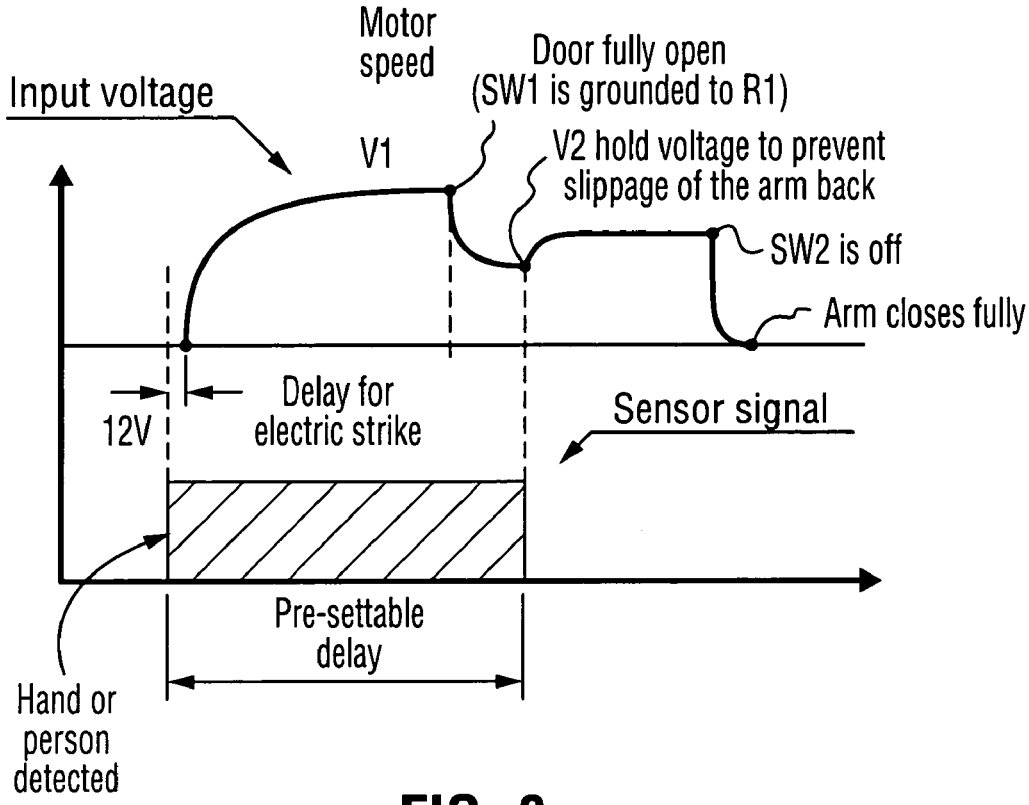
FIG. 8*e* is a schematic illustration demonstrating input voltages controlling speed and direction of the motor.

FIG. 8*d* illustrates a simple and effective way of providing charging impulse to the battery during and shortly after the completion of the opening cycle while upper MOSFET M1 (FIG. 8*b*) remains open. Resistor R3 provides safe trickle charging of the battery in between the cycles.

Figure 9:
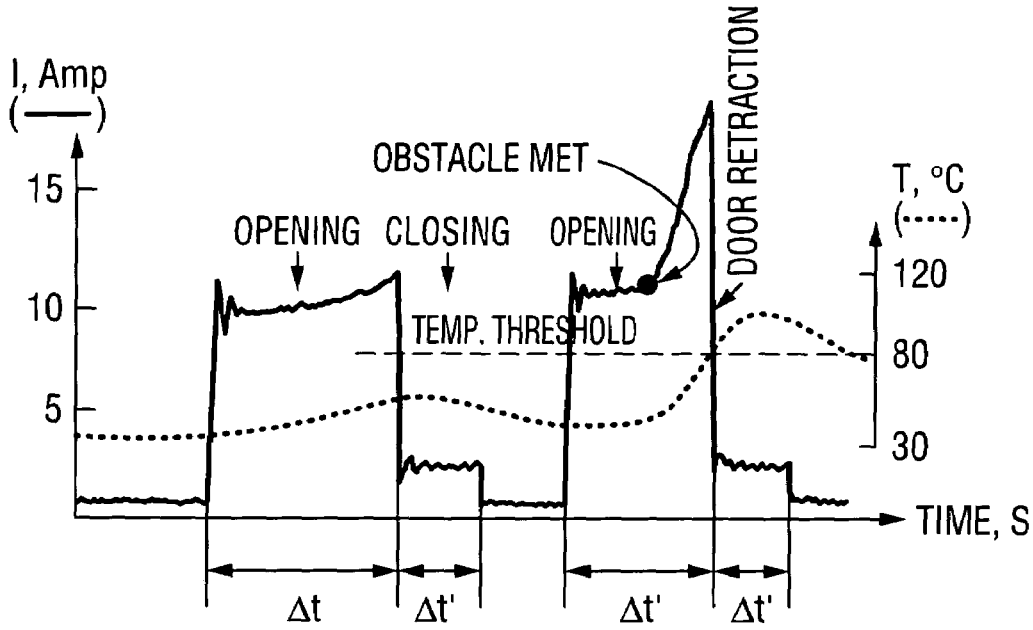
FIG. 9 provides more detailed illustration of the operation of the overload protection device showing a graphical representation of the relationship between the motor current of the door operator system of the present invention and status (temperature) of the said overload protective device.

FIG. 9 illustrates functionality of the overload limiting device in greater detail. When the door encounters an obstacle during an opening cycle, the current through the motor increases and in a stall state, the current reaches its maximum. This condition is very undesirable. Contrary to the devices known from the prior art which are subject to frequent malfunctions due to presence of high current peaks at the starting moment of the door or sudden reversing from the door closure cycle into the opening cycle, when the roller 7 strikes the pilot plate at a higher speed, the present configuration provides for a smooth and reliable overload protection and retraction of the door in the situation where an obstacle is encountered.

Another protective measure is a clutch or torque limiting device combined with one of the members of the gear train, for instance with pinion gear shaft referenced in FIG. 6*a*.

The utilization of the thermal inertia properties of a semi-conductor system (a resettable fuse, diode with heater, etc.) provides a further alternative. By utilizing a rectifier diode, upon heating, the reverse impedance of the diode is reduced dramatically. The heating requires a certain amount of time before the threshold can be reached; this eliminates jerking movements of the door during retraction from the obstacle and then trying to move forwards as soon as the current drops. This is quite common to direct current limiting systems. Also, the cooling time needed to reach the threshold delays the circuit from reverting into an opening cycle which provides for door full retraction, not simply stopping at the point of meeting the obstacle.

The diode 54 represents just one of example of the overload protection device incorporating thermal inertia phenomena. Thermistors and any of other electronic components known for their ability to change properties upon heating or cooling can be alternatively employed. One of the practical variants of such systems includes a resettable fuse shown in the FIG. 8*c* and provides for limiting the current passing through the motor on the opening cycle only. The beneficial features of the protective device relate to the fact that some time is required for the temperature to reach a threshold value, which eliminates and rectifies false events, and to go back below the threshold value, which provides a natural delay for the door to be fully retracted (closed). This is contrary to a direct feedback device which results in chaotic movements of the door meeting an obstacle.

Figure 10:
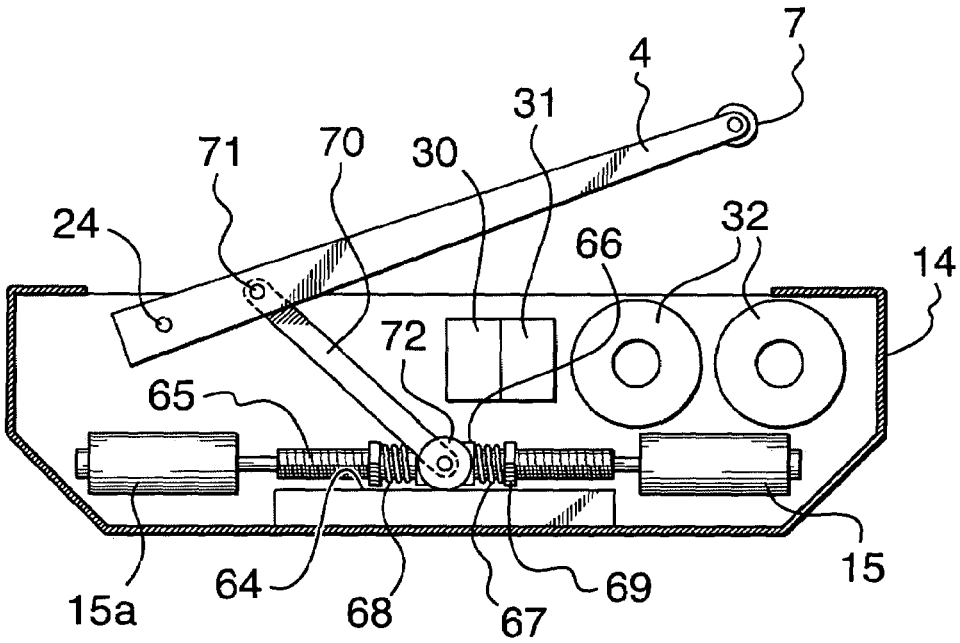
FIG. 10 is yet another configuration of the door opening unit utilizing two electric motors.

FIG. 10 illustrates another variant of the door opener employing one or two motors. The arm 4 is linked with the carrier 66 through the pivoting link or linkage 70 having an axis pin 71 and pivotally connected to the carrier 66 at its axis carrying rolls 72. These rolls can travel along the rail surface 64 which is part of the housing 14. A common threaded axle 65 is connected to motors 15 and 15*a*) and has a nut 69, which is slidably linked with carrier 66 and has a spring suspension consisting of springs 67 and 68. These springs act similar to those described previously in reference to FIG. 4 (21, 22).

Employment of the two motors simplifies the design of the bearing support for the lead screw 65 since the bearings of the motor can serve this purpose which, in turn, reduces the size of the unit. Motor 15 preferably has a thrust bearing (not shown) to counteract the horizontal vector of the force applied from the link 70 and due to the pushing force of the arm 4.

Still another advantage of the device is that its kinematics can be tailored to the desired load distribution during the door opening which improves overall load distribution and enhances durability.

Figure 10A:
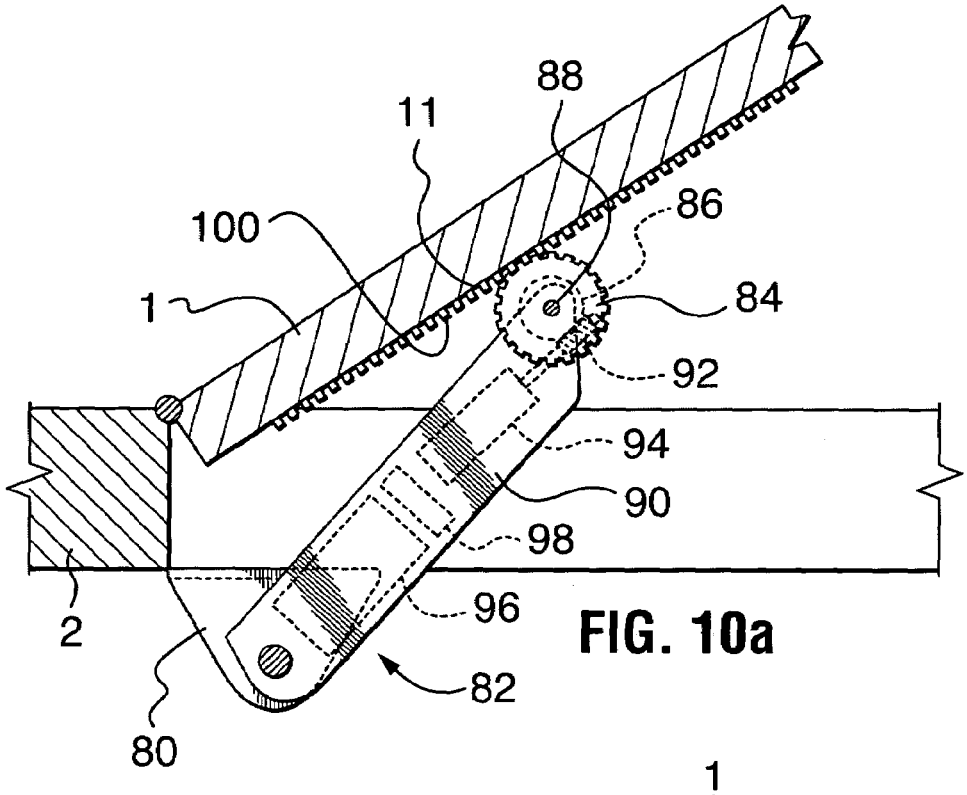
FIG. 10*a* is a schematic illustration of a further variation of the invention according to a different embodiment.
Figure 10B:
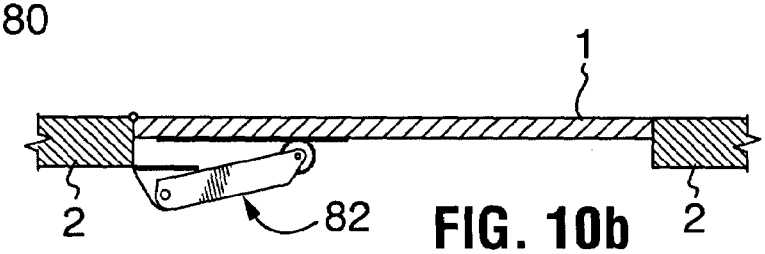
FIG. 10*b* is a schematic illustration of the door in a closed position using the device as set forth in FIG. 10*a;*
Figure 10C:
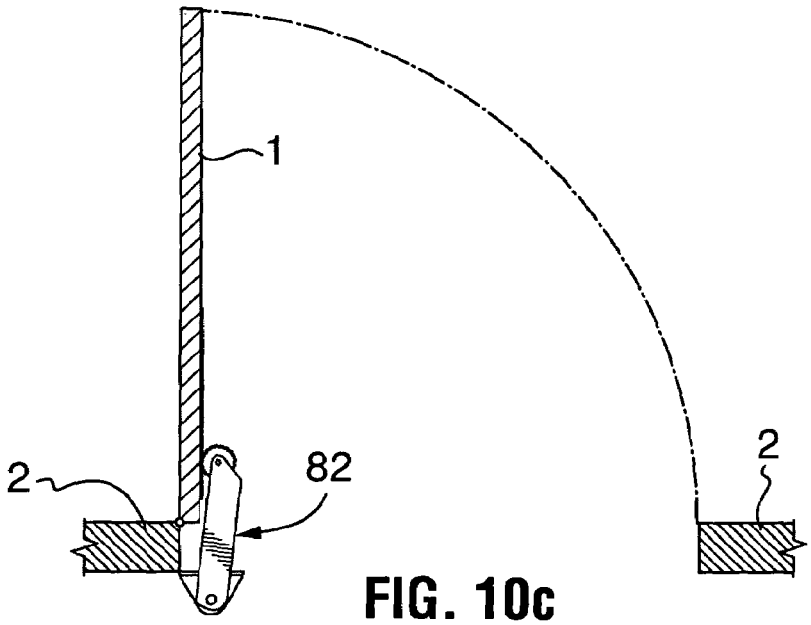
FIG. 10*c* is a schematic illustration of the door in the open position incorporating the device of FIG. 10*a;*

In FIG. 10*a*, shown is a further variation of the invention. In the illustration, the system includes a bracket 80 which is mounted adjacent the door frame. The bracket 80 pivotally connects a drive unit, globally denoted by numeral 82 which drive unit provides a generally circular gear 84 having gear teeth 86 thereon and rotatably mounted at 88 to a housing 90, housing auxiliary components for the drive unit 82. The gear 86 is driven by a worm gear arrangement 92. The worm gear 92 is powered by electric motor 94, with the motor 94 drawing its power from a rechargeable battery 96. Control unit 98 interfaces the battery 96 and motor 94 for proper operation. In this embodiment, the strike blade 11 includes segments, generally denoted by numeral 100, which are adapted for engagement with the gear teeth 86 of gear 84. In this manner, the arrangement between the gear 86 and strike plate 11 is much like a rake and pinion type of system well known to those skilled in the art. In use the worm gear, once activated travels and urges the door from the closed position, shown in FIG. 10*b* to the open position, shown in FIG. 10*c*. Motor power and battery type will be selected depending upon the weight of the door the environment in which the unit is to be used and other factors.

FIG. 11 provides details of the configuration of the suspension system between arm end 23 and geared sector 19 comprised of two pre-stressed springs: tension spring 72 and a compression spring 73. Compression spring is placed between gear 19 and arm's 4 and 23 in such a way that it provides tension for the spring 72.

Yet another variation shown in the FIG. 12 provides for a tension spring 74 with a centrally placed pin 75 providing contact with both the end 23 and the gear 19 and at the same time providing a pre-stressed condition to the spring 74. Similarly, the part, equivalent to the pin 75 can be provided in a form of a tube surrounding the spring 74.

The installation procedure for the door opener according to the present invention is extremely simple and takes little time. The unit is attached to a frame by screws 12 passing through housing 3. An additional hole in either side of the housing 14 is provided for power chord and wires leading to the PIR detector, Touchless Hand Sensor (THS), electric strike or any combination thereof.

The door opener can have a life cycle between 250,000 and 500,000 cycles for a normal duty device and up to 1,500,000 cycles for a heavy duty device. That represents from 3 to 5 years of operation in a fast food washrooms environment.

In the situation when two PIR detectors are employed the door can operate on entry and exit. There can be also a combination of various sensors arranged in a logical circuit so that unwanted opening of the door will not occur.

It will be understood by those skilled in the art that the door opening system discussed herein may be used to close a door during a power failure for fire prevention purposes. Thus, a back up device described previously may be employed in conjunction with the door open system.

When it is determined that power to the system has been interrupted, the energy stored in the capacitors or rechargeable batteries is applied to the motor to energize it and permit the motor to close the arm 4 in the absence of externally applied energy.

The temperature condition of the unit and especially the motor should be closely monitored to avoid overheating, which would lead to the reduction of its performance and reduce reliability. The thermal sensing means attached to a motor will provide additional control where increased temperature of its sensor can be based not only on an immediate current consumption by a motor, but also on the overall heat condition.

Another variation is to employ a cooling fan to provide adequate cooling for the motor(s).

Although embodiments of the invention have been described above, it is limited thereto and it will be apparent to those skilled in the art that numerous modifications form part of the present invention insofar as they do not depart from the spirit, nature and scope of the claimed and described invention.

We claim:

1. An automatic portable door operating system for controlling the movement of a door, said system comprising:

a housing;

an arm extending from said housing having a free end for contacting a door for opening and releasing of said door, said arm being independent of said door;

a worm gear linked with a sectored gear positioned within said housing, said sectored gear connected to said arm at an end other than said free end for imparting movement to said arm, said sectored gear connected at a second point to said arm by a suspension system;

said suspension system connected between said arm and said sectored gear for dampening load experienced by operating said system when said arm contacts a door, said suspension system including spring means connected between said arm and said sectored gear;

a motor connected to said worm gear for providing movement to said sectored gear;

sensor means for actuating said system;

a power supply for supplying power to said motor; and control means for controlling said motor.

2. The system as set forth in claim 1, wherein said system further includes an interrupt arrangement for interrupting said motor when said arm is fully retracted or when at least one of said geared sector or said arm become jammed.

3. The system as set forth in claim 2, wherein said interrupt arrangement further includes a flexible plate mounted within said housing responsive to motion of said sectored gear.

4. The system as set forth in claim 1, wherein said sectored gear comprises a semicircular gear.

5. The system as set forth in claim 1, wherein said system further includes an interrupt arrangement for interrupting said motor when said arm is fully retracted or when at least one of said geared sector or said arm become jammed.

6. The system as set forth in claim 5, wherein said interrupt arrangement includes first switch means and second switch means for responding to movement of said arm.

7. The system as set forth in claim 5, wherein said interrupt arrangement further includes a flexible plate mounted within said housing responsive to motion of said sectored gear.

8. The system as set forth in claim 7, wherein said flexible plate further includes a soft pad extending toward said arm.

9. The system as set forth in claim 7, wherein said second switch means is mounted within said housing adjacent said flexible plate.

10. The system as set forth in claim 1, wherein said free end of said arm includes a low friction means for providing sliding contact against a door.

* * * * *